US011002445B2

(12) United States Patent
Paltrinieri et al.

(10) Patent No.: US 11,002,445 B2
(45) Date of Patent: May 11, 2021

(54) GAS BURNER FOR BOILER

(71) Applicant: WORGAS BRUCIATORI S.R.L., Formigine (IT)

(72) Inventors: Tullio Paltrinieri, Formigine (IT); Marco Fracchini, Formigine (IT); Paolo Gilli, Formigine (IT)

(73) Assignee: WORGAS BRUCIATORI S.R.L., Modena (IT)

( * ) Notice: Subject to any disclaimer, the term of this patent is extended or adjusted under 35 U.S.C. 154(b) by 114 days.

(21) Appl. No.: 16/343,577

(22) PCT Filed: Oct. 17, 2017

(86) PCT No.: PCT/IB2017/056433

§ 371 (c)(1),
(2) Date: Apr. 19, 2019

(87) PCT Pub. No.: WO2018/073737

PCT Pub. Date: Apr. 26, 2018

(65) Prior Publication Data

US 2020/0049345 A1 Feb. 13, 2020

(30) Foreign Application Priority Data

Oct. 21, 2016 (IT) ..... 102016000106409

(51) Int. Cl.
*F23D 14/10* (2006.01)

(52) U.S. Cl.
CPC .... *F23D 14/105* (2013.01); *F23D 2203/1012* (2013.01); *F23D 2900/00003* (2013.01); *F23D 2900/14001* (2013.01)

(58) Field of Classification Search
CPC ..... F24C 3/085; F24C 3/126; F24C 15/017; F24C 3/08; F24C 3/067; F24C 3/122; F24C 3/124; F24C 3/14; F24C 7/083; F24C 15/36; F24C 3/082; F24C 15/001; F24C 15/12; F24C 3/027; F24C 3/087; F24C 3/103; F24C 3/12; F24C 7/086; F24C 15/006; F24C 15/10; F24C 15/015; F24C 15/106; F24C 15/2021; F24C 15/2042;
(Continued)

(56) References Cited

U.S. PATENT DOCUMENTS 3,314,610 A 4/1967 Reznor
3,469,791 A 9/1969 Lancy
(Continued)

FOREIGN PATENT DOCUMENTS

EP 2083217 A1 7/2009

OTHER PUBLICATIONS

International Search Report for corresponding application PCT/IB2017/056433 filed Oct. 17, 2017; dated Apr. 24, 2018.

*Primary Examiner* — Jason Lau
(74) *Attorney, Agent, or Firm* — Cantor Colburn LLP

(57) ABSTRACT

A gas burner (1) comprises a support plate (2) with a passage opening (8) for the gas and an annular wall (11) formed around the passage opening (8), a diffusing wall (19) and a further flow element (20,21,22) inserted on the annular wall (11) in flow communication with the passage opening (8), wherein the annular wall (11) forms a plurality of punches (16) with a recess (17) and an opposite projection (23), wherein the recess (17) accommodates a locking protuberance (25) of the diffusing wall (19) and the projection (23) extends in a locking hole (24) of the further flow element (20, 21, 22).

13 Claims, 11 Drawing Sheets

Figure 1A:
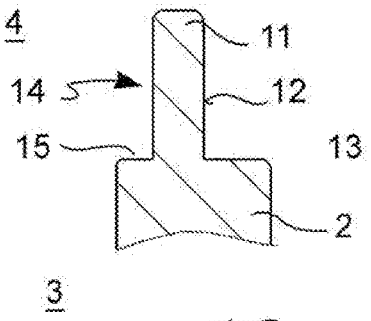

(58) Field of Classification Search
CPC .. F24C 15/2085; F24C 15/2092; F24C 15/24; F24C 15/28; F24C 15/30; F24C 1/04; F24C 1/06; F24C 3/008; F24C 3/02; F24C 3/045; F24C 3/047; F24C 3/10; F24C 5/04; F23D 14/06; F23D 2900/14064; F23D 2900/14062; F23D 14/04; F23D 14/72; F23D 14/14; F23D 14/58; F23D 14/065; F23D 14/64; F23D 14/70; F23D 14/84; F23D 2203/005; F23D 23/00; F23D 2900/00003; F23D 2900/14042; F23D 2900/14063; F23D 3/40; F23D 11/448; F23D 11/46; F23D 14/045; F23D 14/08; F23D 14/105; F23D 14/12; F23D 14/125; F23D 14/145; F23D 14/18; F23D 14/26; F23D 14/28; F23D 14/46; F23D 14/56; F23D 14/62; F23D 2203/1015; F23D 2203/102; F23D 2207/00; F23D 2212/005; F23D 2212/20; F23D 2900/14005; F23D 2900/14061; F23D 2900/21002; F23D 5/123; F23D 5/126; F23D 5/04; F23D 5/045; F16L 1/123; F16L 1/16; F16L 53/30; F16L 53/38; F16L 59/065; F16L 7/00; F16L 7/02; F16L 9/18; F16L 9/19; F16L 9/20; F16L 21/08; F16L 23/024; F16L 23/0283; F16L 23/032; F16L 25/065; F16L 33/223; F16L 47/041; F16L 33/22; F16L 19/02; F16L 19/0212; F16L 2201/10; F16L 2201/60; F16L 37/18; F16L 3/015; B65D 43/16; B65D 2543/00296; B65D 43/22; B65D 11/04; B65D 17/4012; B65D 1/165; B65D 21/2019; B65D 2251/0021; B65D 2251/0025; B65D 2251/0028; B65D 2251/0081; B65D 2251/009; B65D 2251/0093; B65D 2251/20; B65D 2401/50; B65D 2517/0041; B65D 2517/0082; B65D 2543/00046; B65D 2543/00101; B65D 2543/00194; B65D 2543/00305; B65D 2543/00361; B65D 2543/00462; B65D 2543/00509; B65D 2543/00537; B65D 2543/00555; B65D 2543/00666; B65D 2543/00703; B65D 2543/00731; B65D 2543/00814; B65D 2543/00944; B65D 2547/066; B65D 25/04; B65D 25/108; B65D 25/22; B65D 25/24; B65D 41/00; B65D 41/28; B65D 41/32; B65D 41/34; B65D 41/40; B65D 43/0225; B65D 43/162; B65D 43/163; B65D 43/26; B65D 47/00; B65D 47/08; B65D 47/0838; B65D 47/128; B65D 47/18; B65D 50/00; B65D 51/18; B65D 51/222; B65D 77/04; B65D 77/06; B65D 81/3865; B65D 81/3874; B65D 83/0022; B65D 83/08; B65D 83/0805; B65D 83/14; B65D 83/16; B65D 83/201; B65D 83/202; B65D 83/205; B65D 83/206; B65D 83/207; B65D 83/40; B65D 83/48; B65D 83/525; B65D 83/54; B65D 83/546; B65D 83/68; B65D 83/682; B65D 85/80; F23M 5/04; F23M 5/00; F23M 5/085
See application file for complete search history.

(56) References Cited

U.S. PATENT DOCUMENTS

| | | | |
|---|---|---|---|
| 5,022,352 | A | 6/1991 | Osbourne |
| 2014/0011142 | A1 | 1/2014 | Bertelli |

GAS BURNER FOR BOILER

The present invention relates to a gas burner for boiler.

Gas boilers of the prior art comprise a support plate connectable to a combustion chamber of the boiler to ensure the closure of the combustion chamber and the positioning of the burner with respect to such a combustion chamber. The support plate defines an opening for the passage of a premixed gas-air mixture from an outer side to an inner side of the plate itself. On the outer side of the support plate, at the passage opening, a duct may be connected for supplying the premixed gas-air mixture to the burner. The connection between the supply duct and the support plate takes place by means of a plurality of screws and by means of the interposition of a gasket. The burner further includes a diffuser through which the gas is conveyed and which determines a flame pattern for the production of heat. Usually, the diffuser comprises a wall equipped with a plurality of tiny holes and having an inner side in flow connection to the supply duct and an outer side on which the combustion takes place. Upstream of the diffuser (with reference to the flow direction of the gas-air mixture), a further flow element (referred to as an element influencing the flow, e.g., the flow rate and velocity distribution on the flow section, of the gas to the diffuser) may also be provided, such as a distribution device, e.g. a distribution wall with a plurality of through holes, configured to distribute the gas-air mixture to the diffusing wall in a substantially uniform manner or still in the desired manner.

The diffuser and the distributor are rigidly connected to the support plate, in particular on the inner side thereof, so that, once the burner is mounted, the diffuser protrudes in the combustion chamber of the boiler and the supply duct extends outwardly of the latter.

For connecting the diffuser and the distributor to the support plate, a so-called stainless steel connection flange is provided. The connection flange is manufactured separately from the support plate and is connectable thereto by means of a plurality of screws and by means of the interposition of a special, high heat resistant gasket. The connection flange has a connecting portion protruding in the combustion chamber and to which the diffuser and the distributor are fastened.

As it is well known, the heat generated by the combustion on the outer side of the diffusing wall is driven by means of the hot combustion gases to a heat exchanger for heating up a fluid, for example water, which is then conveyed to an application, for example a heating system of an industrial process, a living environment or the like.

In order to simplify the structure of the burner, and to reduce the number of individual components and connection members to be assembled, EP2083217A proposes to make a support plate with a first connecting portion for removably connecting the support plate to the combustion chamber, a second connecting portion for connecting a gas supply duct, and a third connecting portion (connection flange) for directly connecting the diffusing wall to the support plate, in which at least the third connecting portion (diffuser connection flange) is formed in one piece with the support plate, in particular by means of aluminum die-casting. This allows to completely remove the connection flange, essential in the burners of the prior art, and to obtain a saving in material and in manufacturing and mounting costs. On the other hand, the provision of the support plate and of the connection flange in one piece involves wall thicknesses and/or the employment of support plate materials which do not allow traditional connections by means of welding between two stainless steel sheets.

It is therefore the object of the present invention to propose a burner with a support plate formed in one piece with the diffuser connection flange, in particular of aluminum, and a method for manufacturing the burner, having such features to allow a fast, precise and cost-effective junction between the support plate and the diffuser and/or further flow elements, e.g. a distributor.

These and other objects are achieved by means of a burner according to claim 1 and by means of a method according to claim 11.

According to an aspect of the invention, a gas burner (1) comprises a support plate (2) with a passage opening (8) for the gas and an annular wall (11) formed around the passage opening (8), a diffusing wall (19) and a further flow element (20,21,22) inserted on the annular wall (11) in flow communication with the passage opening (8), wherein the annular wall (11) forms a plurality of punches (16) with a recess (17) and an opposite projection (23), wherein the recess (17) accommodates a locking protuberance (25) of the diffusing wall (19) and the projection (23) extends in a locking hole (24) of the further flow element (20, 21, 22).

In accordance with a further aspect of the invention, the burner is manufactured by means of a method which includes:

- inserting an annular end region (34) of the flow element (20, 21, 22) in a female seat formed by the annular wall (11),
- then, punching the annular wall (11) at the positions of the locking holes (24) so that each punching (16) forms a recess (17) and an opposite projection (23) which protrudes from the annular wall (11) into the corresponding locking hole (24) of the flow element (20, 21, 22) for locking it,
- inserting the diffuser (19) on the flow element (20, 21, 22) and on a male seat formed by the annular wall (11) and overlapping the reference holes (26) of the diffusing wall (19) on the recesses (17) of the punches (16) of the annular wall (11),
- bending, by punching, the edges of the reference hole (26) into the recesses (17) of the annular wall (11) for a mutual locking thereof.

The burner thus configured and manufactured has a reduced number of individual components, reliably connected to one another, by means of a shape connection, and with a certain and facilitated mutual positioning by virtue of the (concentric) alignment between the recess 17 and the projection 23 of each punching 16. Furthermore, the junction between different materials (stainless steel and aluminum) and between different wall thicknesses (FIG. 2D) is facilitated.

In order better understand the invention and appreciate the advantages thereof, a description of a number of non-limiting exemplary embodiments is provided below, with reference to the accompanying drawings, in which:

FIGS. 1A to 1E are diagrammatic sectional views showing the steps for manufacturing a burner in accordance with the invention;

FIGS. 2A to 2D are perspective (FIG. 2A), sectional (FIG. 2B) and exploded (FIG. 2C) views, and a view of an enlarged detail (FIG. 2D) of a burner according to an embodiment, FIGS. 3A to 3D are perspective (FIG. 3A), sectional (FIG. 3B) and exploded (FIG. 3C) views, and a view of an enlarged detail (FIG. 3D) of a burner according to a further embodiment, FIGS. 4A to 4D are perspective (FIG. 4A), sectional (FIG. 4B) and exploded (FIG. 4C) views, and a view of an enlarged detail (FIG. 4D) of a burner according to a further embodiment, FIGS. 5A to 5D are perspective (FIG. 5A), sectional (FIG. 5B) and exploded (FIG. 5C) views, and a view of an enlarged detail (FIG. 5D) of a burner according to a further embodiment, FIGS. 6A to 6D are perspective (FIG. 6A), sectional (FIG. 6B) and exploded (FIG. 6C) views, and a view of an enlarged detail (FIG. 6D) of a burner according to a further embodiment, FIGS. 7A to 7D are perspective (FIG. 7A), sectional (FIG. 7B) and exploded (FIG. 7C) views, and a view of an enlarged detail (FIG. 7D) of a burner according to a further embodiment, FIGS. 8A to 8D are perspective (FIG. 8A), sectional (FIG. 8B) and exploded (FIG. 8C) views, and a view of an enlarged detail (FIG. 8D) of a burner according to a further embodiment, FIGS. 9A to 9D are perspective (FIG. 9A), sectional (FIG. 9B) and exploded (FIG. 9C) views, and a view of an enlarged detail (FIG. 9D) of a burner according to a further embodiment, FIGS. 10A to 10D are perspective (FIG. 10A), sectional (FIG. 10B) and exploded (FIG. 10C) views, and a view of an enlarged detail (FIG. 10D) of a burner according to a further embodiment, FIGS. 11A to 11D are perspective (FIG. 11A), sectional (FIG. 11B) and exploded (FIG. 11C) views, and a view of an enlarged detail (FIG. 11D) of a burner according to a further embodiment, With reference to the Figures, a gas burner for boilers, i.e. a burner for generating heat by means of the combustion of a combustible gas, in general, or a mixture of combustible gas and air, in particular, is generally indicated by reference numeral 1. The burner 1 comprises a support plate 2 with an outer side 3 (intended to be facing away from the combustion chamber) and an inner side 4 opposite to the outer side 3 and intended to be facing into a combustion chamber (not shown). The support plate 2 is removably connectable to the combustion chamber by means of one or more first connecting portions 5, preferably a plurality of through holes 6 formed in the vicinity of a perimeter or outer edge 7 of the support plate 2 and intended for accommodating screws for fastening the support plate 2 to the combustion chamber of the boiler or for another application.

The support plate 2 further defines a passage opening 8 for the passage of the mixture 9 of combustible and air from the outer side 3 thereof to the inner side 4 thereof and, consequently, from the outside of the combustion chamber to the inside thereof.

In order to allow the supplying of the combustible mixture to the burner 1, a second connecting portion 10 is provided, formed on the outer side 3 of the support plate 2 and configured to connect a supply duct 11 in flow communication with the passage opening 8.

According to an embodiment, the second connecting portion 10 includes a pipe portion, preferably formed in one piece with the support plate 2, for example by means of aluminum die-casting. Such a pipe portion may form at least one part of or the entire supply duct 11

Alternatively, the second connecting portion may include a plurality of holes preferably blind, internally threaded and distributed around the passage opening 8. The blind holes open on the outer side 4 of the support plate 2 and are adapted to accommodate screws for fastening (with or without the interposition of a gasket) the supply duct 11 to the support plate 2 (not shown).

The support plate 2 further includes a third connecting portion 18, formed on the inner side 4 in the vicinity of the passage opening 8 and configured to allow a connection of a diffusing wall 19 and/or of a further flow element (e.g. a distribution wall 20, a distribution baffle 21, an anti-noise trumpet 22 or a Venturi insert) to the support plate 2, so that such a diffusing wall and/or the further flow element 20, 21, 22 are placed in flow communication with the passage opening 8.

The third connecting portion 18 and the support plate 2 are formed in one piece, preferably by means of aluminum die-casting.

According to an embodiment, the third connecting portion 18 includes a wall 11 which protrudes from the support plate 2 towards the inner side 4 and which extends (preferably in an annular manner, e.g. in a circular, oval, or polygonal manner) around the passage opening 8. The wall 11 may form a continuous closed ring or, alternatively, the wall 11 may form interruptions or may be formed by a sequence of protuberances spaced apart from one another (not shown).

Figure 1B:
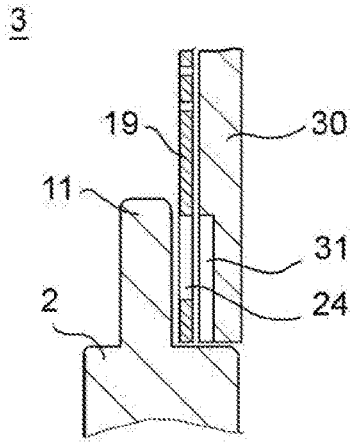
Figure 1E:
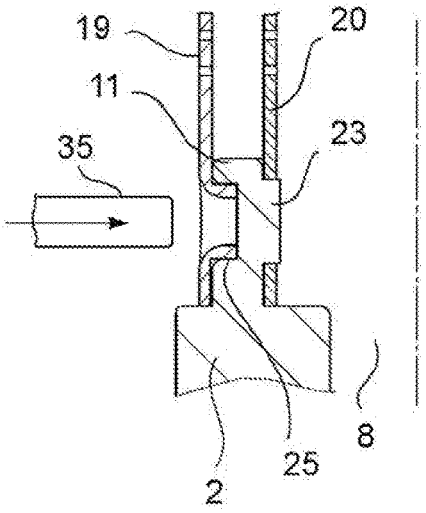
Figure 1C:
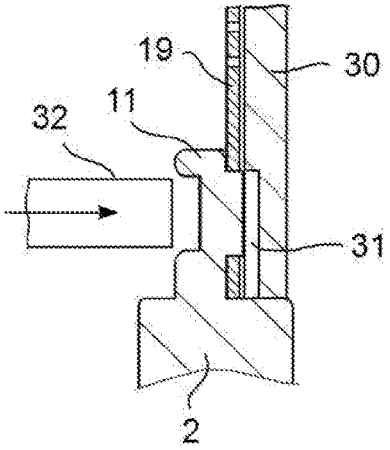
Figure 1D:
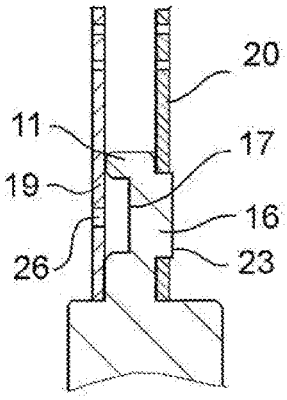
Figure 2C:
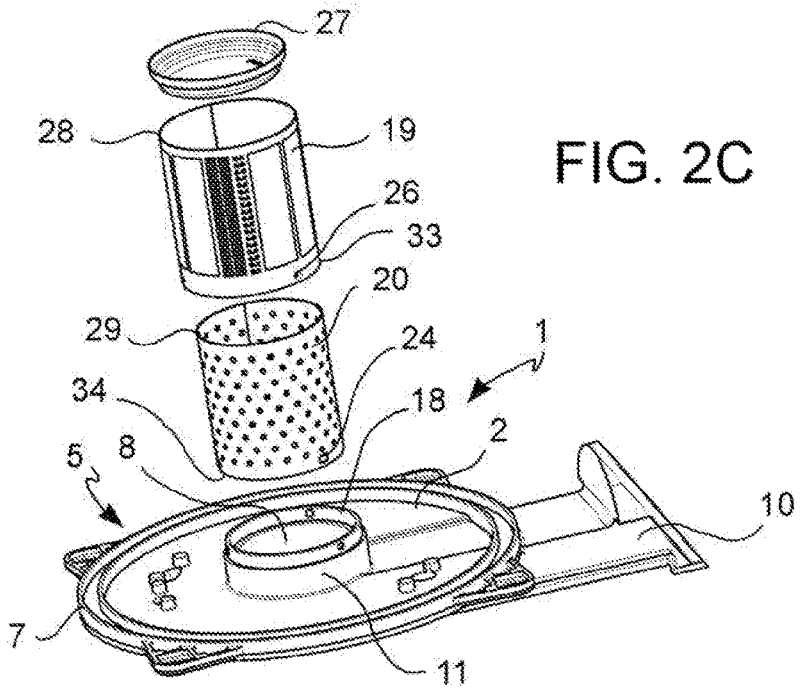
Figure 2A:
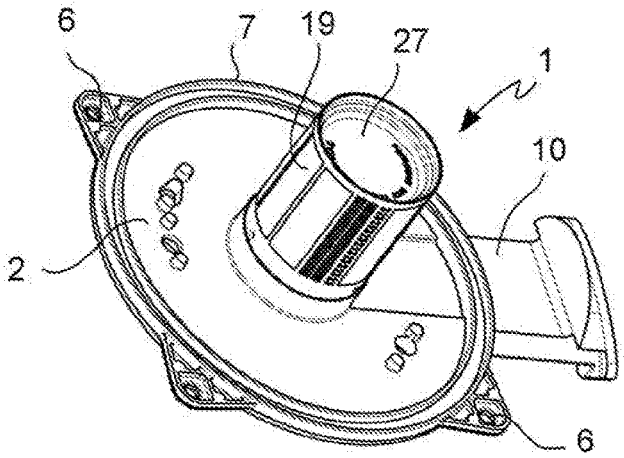
Figure 2D:
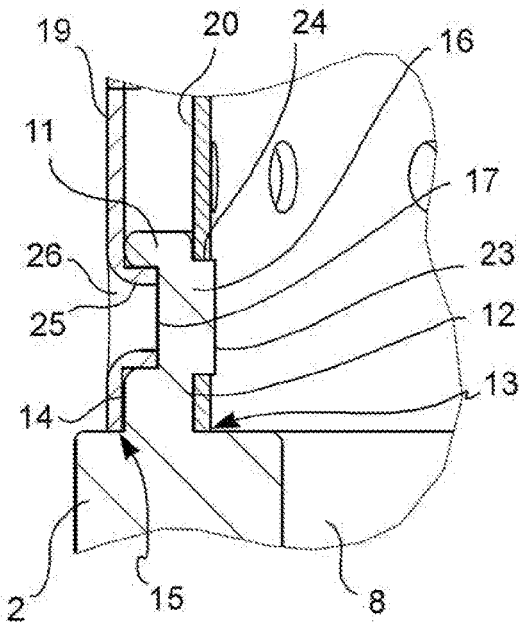
Figure 2B:
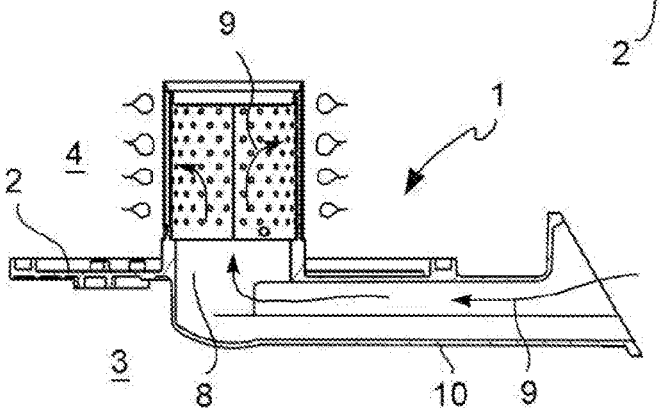
Figure 3C:
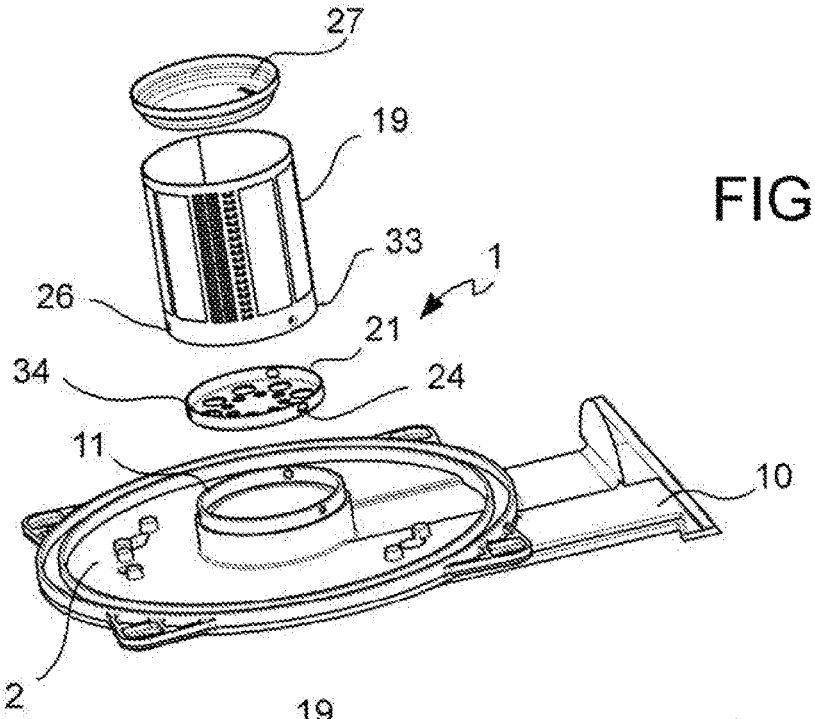
Figure 3A:
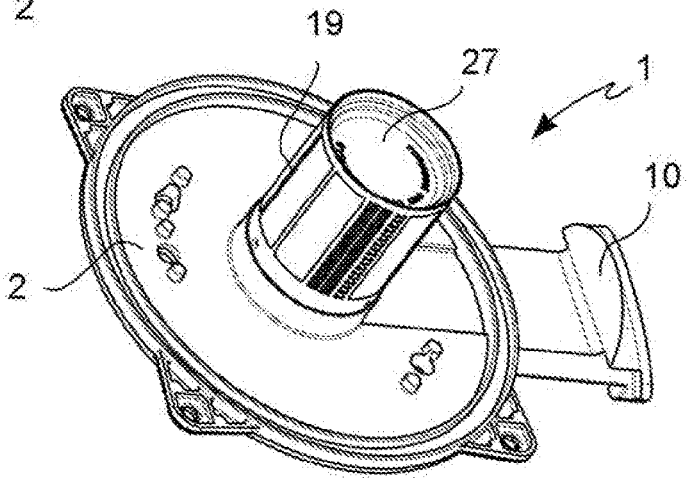
Figure 3D:
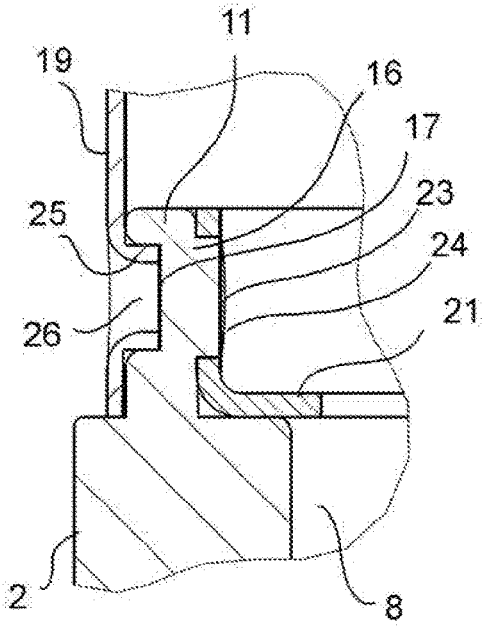
Figure 3B:
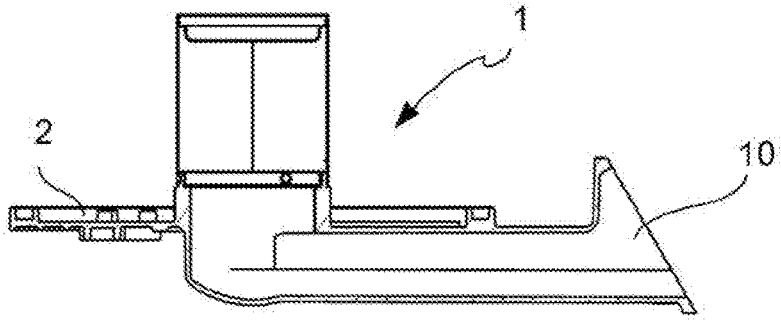
Figure 4C:
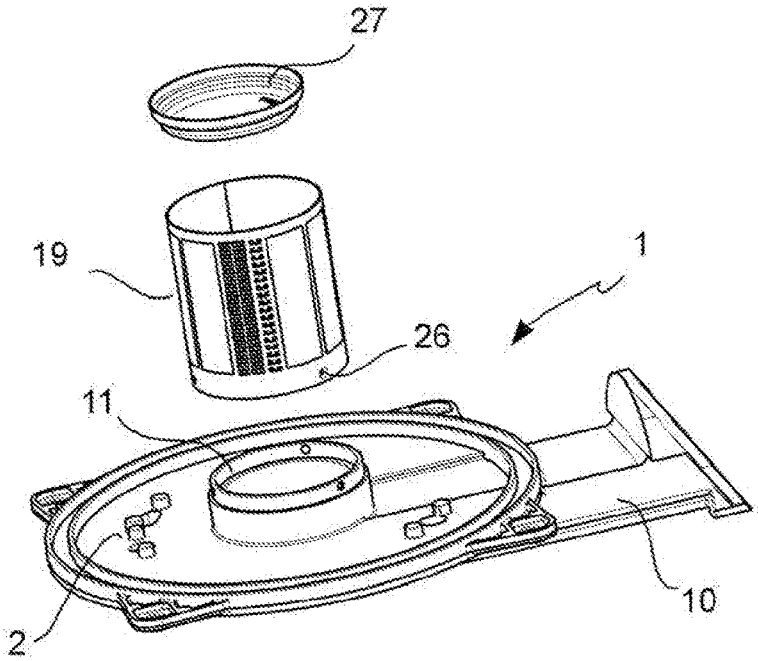
Figure 4A:
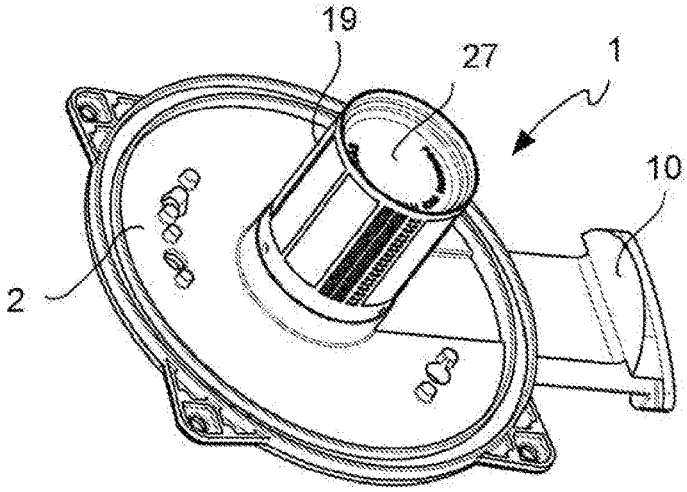
Figure 4D:
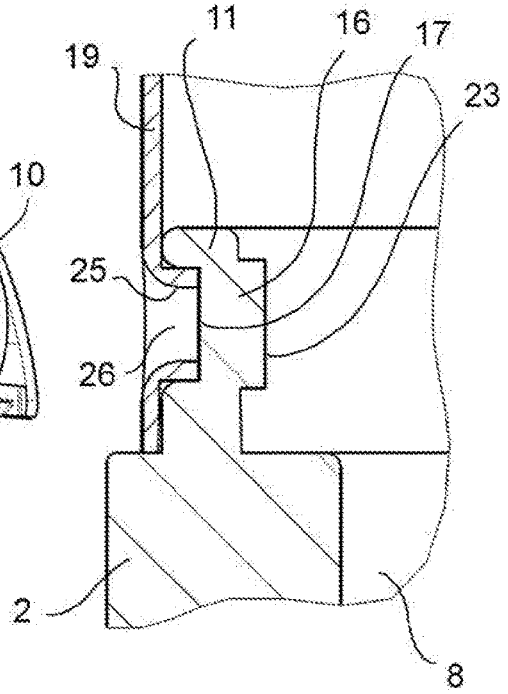
Figure 4B:
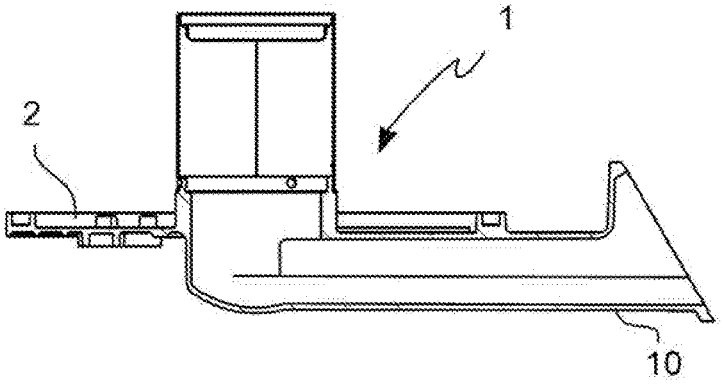
Figure 5C:
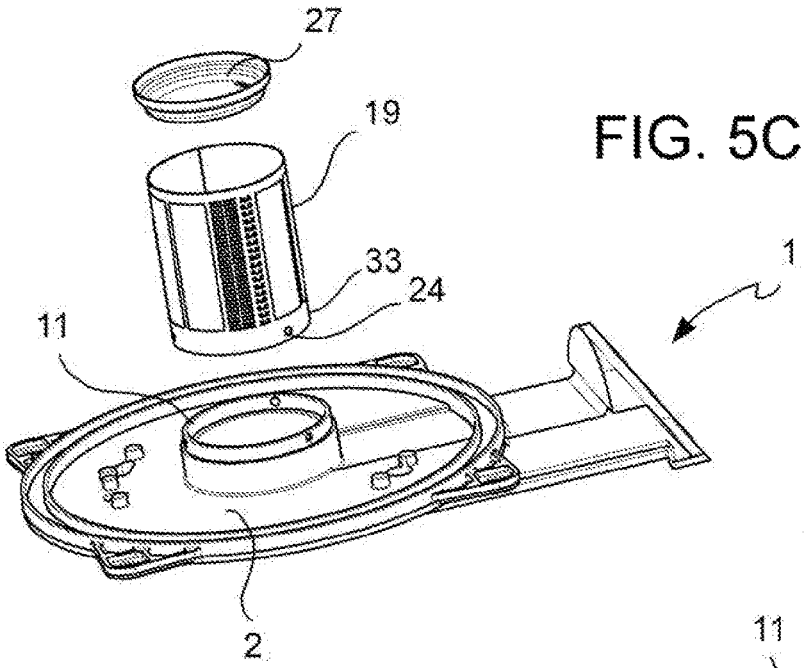
Figure 5A:
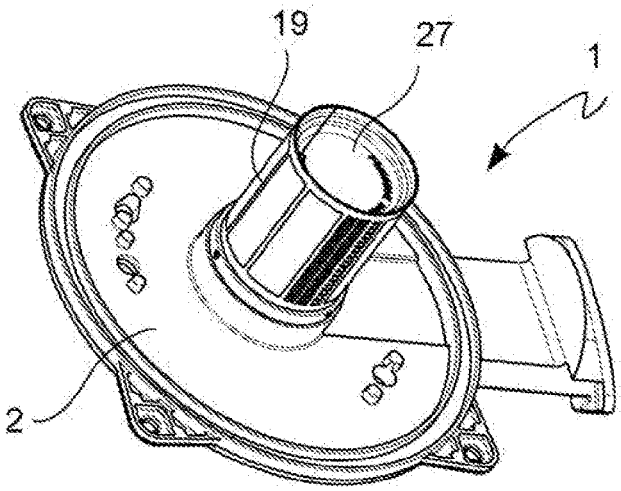
Figure 5D:
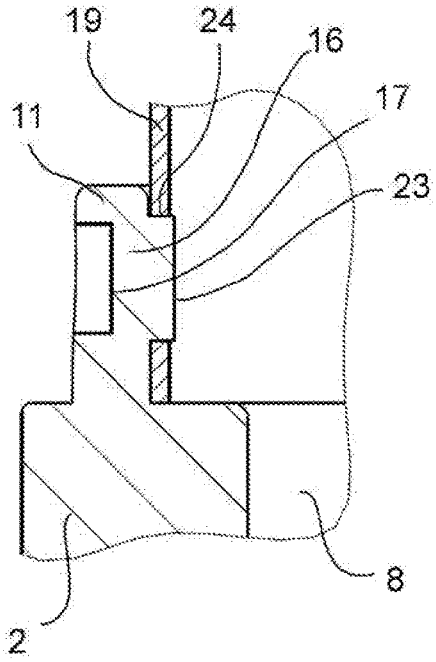
Figure 5B:
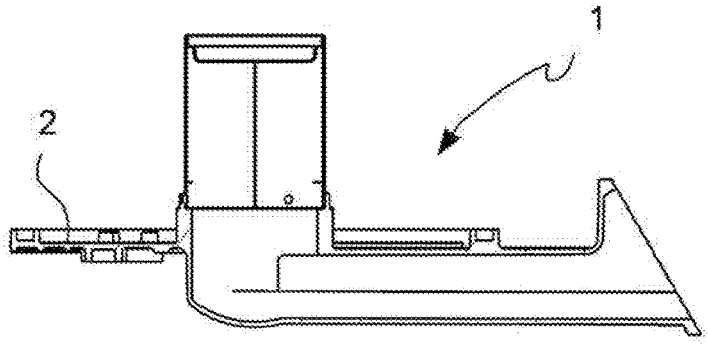
Figure 6C:
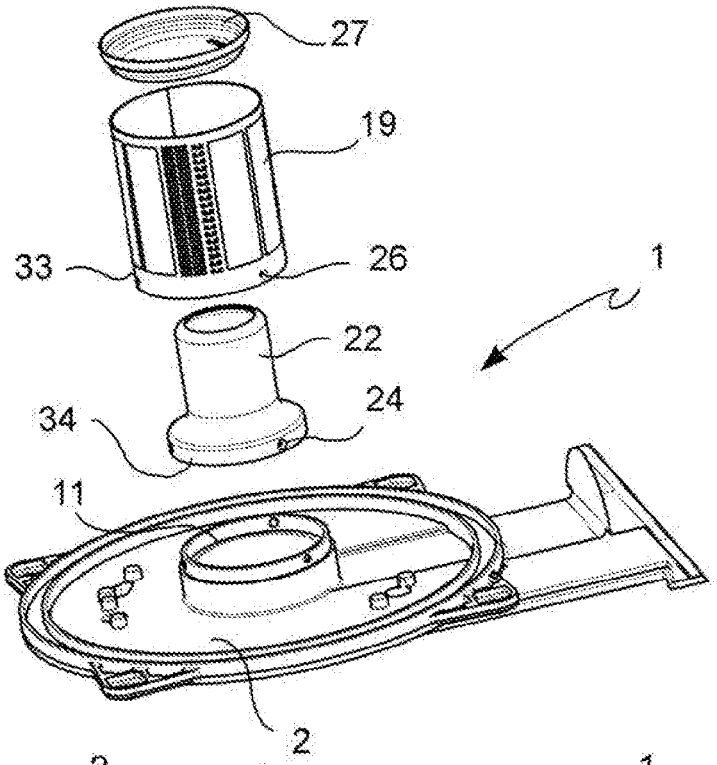
Figure 6A:
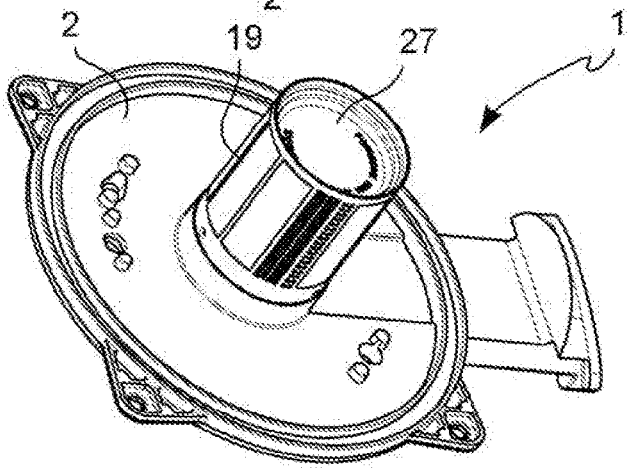
Figure 6D:
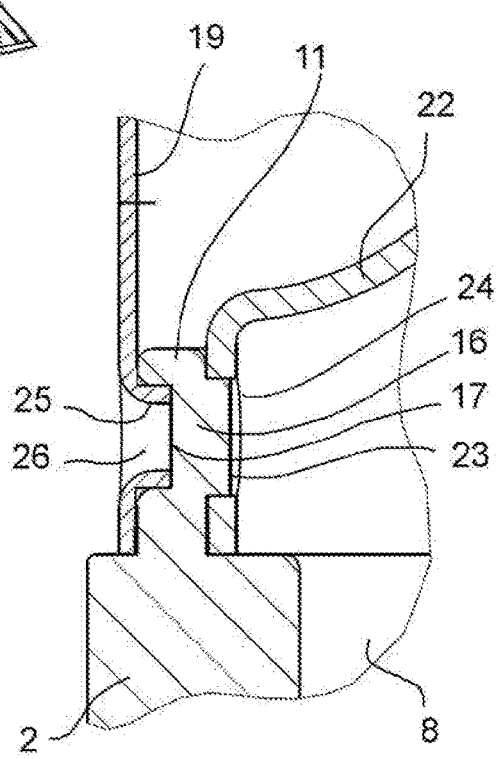
Figure 6B:
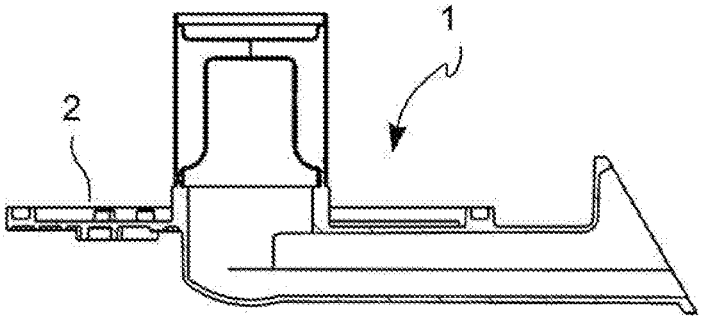
Figure 7C:
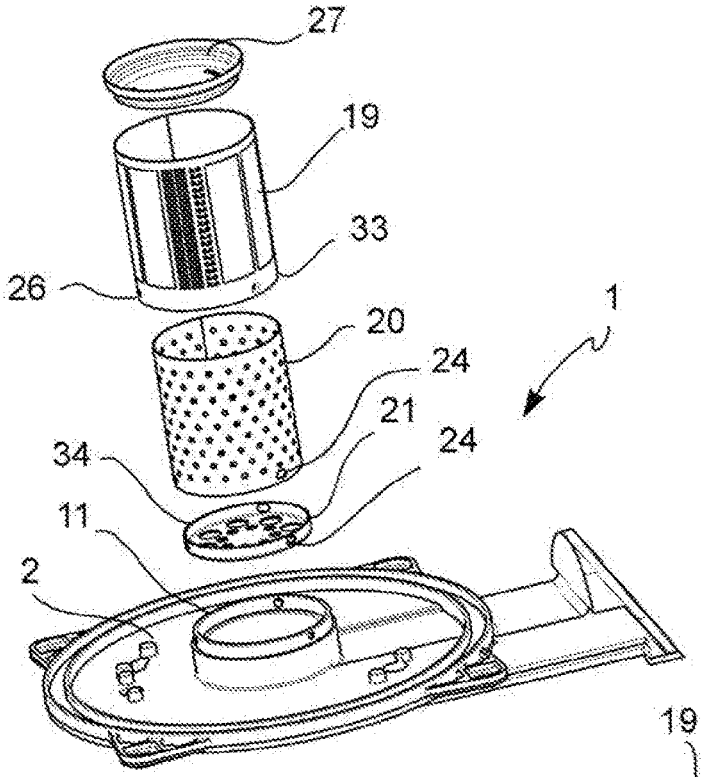
Figure 7A:
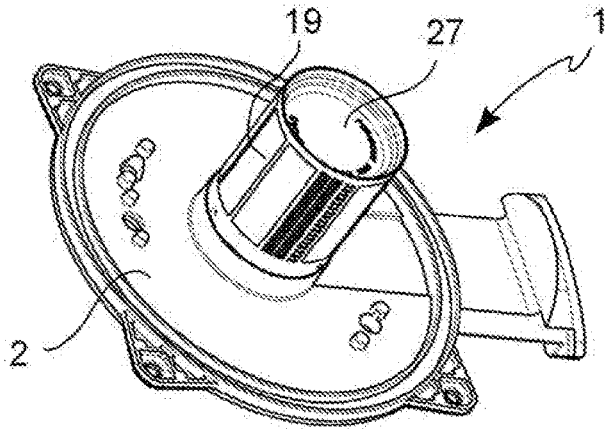
Figure 7D:
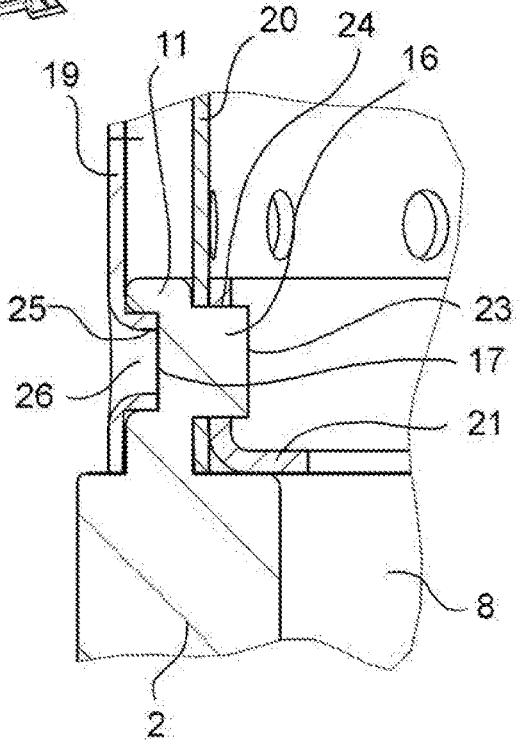
Figure 7B:
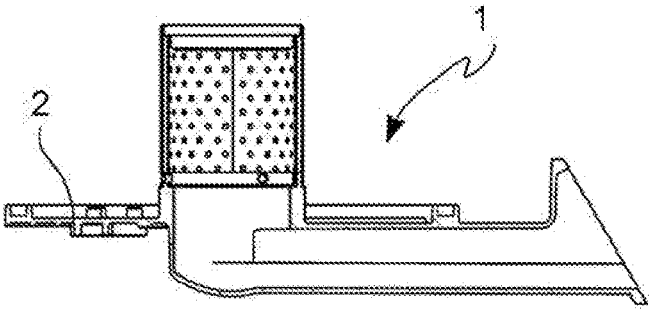
Figure 8C:
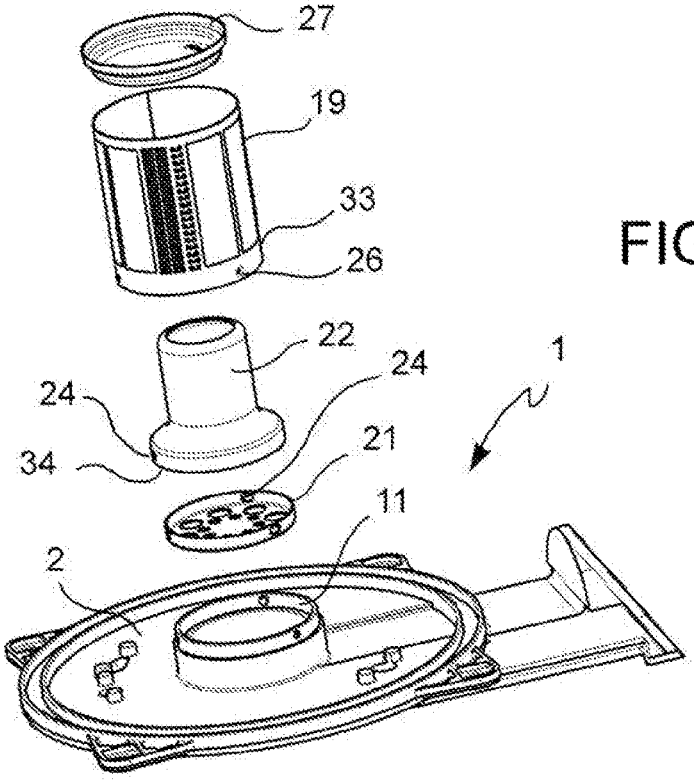
Figure 8A:
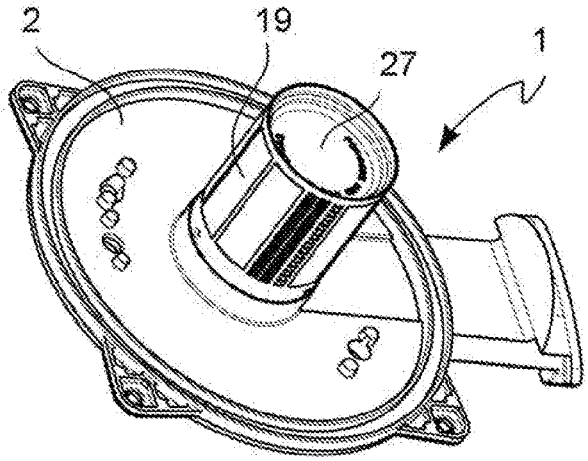
Figure 8D:
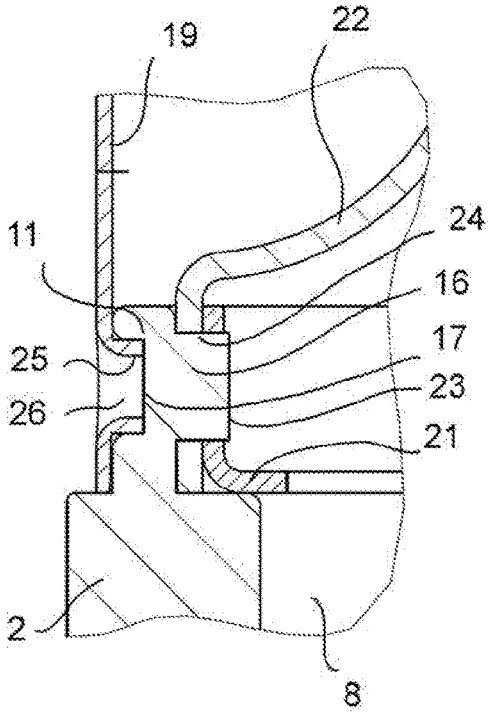
Figure 8B:
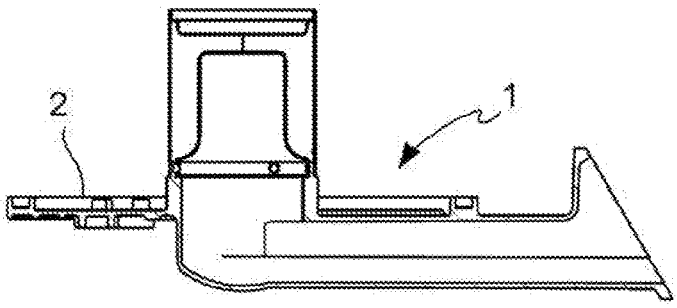

The third connecting portion 18 is configured to receive and support, by means of the insertion "into" or "on" (as shown in FIGS. 1D, 2D), at least:

the diffusing wall 19 (FIGS. 2D, 5D) and/or a further flow element, e.g., a distribution wall 20 (FIGS. 2D, 7D), a distribution baffle 21 (FIGS. 3D, 7D), an anti-noise trumpet 22 (FIGS. 6D, 8D), or a Venturi insert (not shown).

According to an embodiment, the third connecting portion 18 receives and supports, by means of the insertion "into" or "on", one of the aforesaid components 19, 20, 21, 22 which, in turn, supports at least another of the aforesaid components 19, 20, 21, 22.

In accordance with an embodiment, the diffuser 19 is substantially cylindrical or in the form of a truncated cone and the distributor 20 is substantially cylindrical or in the form of a truncated cone and may be arranged coaxially inside the diffuser 19 (see FIG. 2D).

Advantageously, the (continuous or interrupted) annular wall 11 forms a radially inner surface 12 which forms a first (female) seat to accommodate, by insertion (for example, with tolerance or by means of press-fit), one of the further flow elements 20, 21, 22 and/or (alternatively) the diffuser 19. The radially inner surface 12 may form a step or abutment 13 which axially defines the first seat and forms a certain geometric reference (support) for the axial positioning of the flow element 20, 21, 22 and of the diffuser 19.

The step 13 preferably extends all around the first seat.

Similarly, the (continuous or interrupted) annular wall 11 may form a radially outer surface 14 which forms a second (male) seat to accommodate, by insertion (for example, with tolerance or by means of press-fit), the diffuser 19 and/or (alternatively) one of the further flow elements 20, 21, 22. The radially outer surface 14 may form a step or abutment 15 which axially defines the second seat and forms a certain geometric reference (support) for the axial positioning of the diffuser 19 and/or of the further flow element 20, 21, 22. The step 15 preferably extends all around the second seat.

The connection between the annular wall 11 and the diffuser 19 and, if present, a further flow element 20, 21, 22 is made integral and locked by virtue of a plurality of punchings 16 in the annular wall 11, in which each punching 16 forms a recess 17 (in the shape of a blind hole) in the radially outer surface 14 and a corresponding projection 23 (in the shape of a pin) on the radially inner surface 12. The recess 17 accommodates a locking protuberance 25 of the diffusing wall 19 and the projection 23 is adapted to engage (extend into) a corresponding locking hole 24 of the further flow element 20, 21, 22, or vice versa.

By virtue of the alignment between the recess 17 and the projection 23 of each punching 16, a proper circumferential and axial alignment is obtained between the diffuser 19 and the further flow element/s 20, 21, 22 and the support plate 2.

In an embodiment, the locking protuberance 25 is formed by a rimming (i.e. a deformation off the edge plane) of a reference hole 26 in the diffusing wall 19 and/or in the further flow element 20, 21, 22.

In order not to hinder the identification of the connection points and to ensure, where desired, the impermeability of the burner 1 at the connection region, the locking protuberances 25 and the respective reference holes 26 are formed in an annular end region 33 of the diffusing wall 19 and/or of the further flow element 20, 21, 22 which is preferably without perforation for the passage of the combustible gas mixture (FIG. 2C). Similarly, also the locking holes 24 are formed in an annular end region 34 of the flow element 20, 21, 22, e.g. of the distributor wall 20, and/or of the diffuser 19 (FIG. 5D), which is preferably without perforation for the passage of the combustible gas mixture (FIG. 2C).

The punchings 16 are spaced apart from one another and arranged in a distributed manner around the circumference of the annular wall 11, preferably at an angle or at a constant distance. The Figures show preferred embodiments with three punchings 16 arranged at an angle of 120°. However, the punchings 16 may be at least 2, for example 3, 4, 5 or 6. The same reasoning may be applied by analogy also to the locking holes 24 and the locking protuberances 25.

The annular wall 11 (preferably of aluminum) has a thickness which is greater than the thickness of the diffusing wall 19 (preferably of stainless steel), preferably the thickness of the annular wall 11 is 2 to 5 times the thickness of the diffusing wall 19.

The closure of the burner 1 on the side opposite to the support plate 2 and, possibly, the proper positioning of the diffusing wall 19 with respect to the further flow element 20, 21, 22 are advantageously ensured by an upper bottom 27 connected (e.g. by means of press-fit and/or welding) to the upper edge 28 of the diffuser 19 and, possibly, connected (e.g. by means of shape coupling with tolerance or press-fit) to an upper edge 29 of the further flow element, e.g. of the distributor 20.

The burner 1 described herein has a reduced number of individual components, reliably connected to one another, by means of a shape connection, and with a certain and facilitated mutual positioning by virtue of the (concentric) alignment between the recess 17 and the projection 23 of each punching 16. Furthermore, the junction between different materials (stainless steel and aluminum) and between different wall thicknesses (FIG. 2D) is facilitated.

The structural and geometric configuration of the burner 1 is also conceived in accordance with a fast and efficient manufacturing process, which will be described below with reference to FIGS. 1A to 1E.

Following the arrangement of the aluminum support plate 2, of the flow element 20, 21, 22 and of the upper bottom 27 (FIG. 1A), the flow element 20, 21, 22, in particular the distributor 20, is inserted in the first (female) seat formed by the radially inner surface 12 of the annular wall 11, until leaning against the inner step 13 (FIG. 1B).

In order to provide a mechanical abutment and prevent undesired deformations, positioning a (radially expandable and retractable) die 30 inside the flow element 20, 21, 22 at the annular wall 11 and expanding the die 30 from the inside against the flow element 20, 21, 22 is advantageous.

The die 30 has recesses 31 placed at the locking holes 24 of the flow element 20, 21, 22 to allow the free formation of the projections 23 and a subsequent extraction of the die 30 (FIG. 1B).

Then, the annular wall 11 is punched at the positions of the locking holes 24 of the flow element 20, 21, 22. The punching takes place from the outside in a radially inward direction, for example by means of a cylindrical punch 32 or of another shape suitable for obtaining the punching 16, with a punching depth smaller than the thickness of the annular wall 11, so that each punching 16 forms a recess 17 (in the shape of a blind hole) in the radially outer surface 14 and a corresponding projection 23 (in the shape of a pin) which protrudes from the radially inner surface 12 of the annular wall 11 into the corresponding locking hole 24 of the flow element 20, 21, 22 for locking it (FIG. 1C).

Preferably, the projection 23 extends through the entire length of the locking hole 24 of the flow element 20, 21, 22 and may slightly show on the opposite side. By virtue of the reaction compression exerted by the die 30, the free end of the projection 23 may be enlarged so as to hinder or prevent a hypothetical radial disengagement/sliding with respect to the locking hole 24.

In case the locking holes 24 are not through holes but blind holes or made as bosses, the projection 23 may still penetrate the hole 24 without, however, showing on the opposite side.

Following the extraction of the punch 32 from the annular wall 11 and the radial retraction and axial extraction of the die 30 from the inside of the flow element 20, 21, 22, a support 2—preassembled flow element assembly is obtained, for example a support 2—distributor 20 assembly.

The diffuser 19 or a preassembled diffuser 19—bottom 27 assembly is thus arranged and inserted on the flow element 20, 21, 22 on the second (male) seat formed by the radially outer surface 14 of the annular wall 11, until leaning against the outer step 15 (FIG. 1D).

The diffuser 19 is oriented angularly so that the reference holes 26 of the diffusing wall 19 are overlapping the punchings 16, in particular on the recesses 17, of the annular wall 11.

In a further punching step (without shearing, e.g., by means of a further punch 35 in the shape of a radial advancement pin with rounded tip), the edges of the reference holes 26 of the diffusing wall 19 are bent into the recesses 17 of the annular wall 11, for a mutual locking thereof (FIG. 1E). To this end, the reference holes 26 initially have a diameter smaller than the diameter of the recesses 17.

Advantageously, the flow element 20, 21, 22, in particular the distributor 20, and the upper bottom 27 are configured for a shape connection thereof, preferably with tolerance, on the opposite side of the support plate 2. Such a shape connection occurs when inserting and connecting the diffuser 19—bottom 27 assembly on the annular wall 11 of the support plate 2.

According to an embodiment, the diffuser 19 engages (in other words: is fitted on) the radially outer surface 14 of the annular wall 11 with interference, i.e. with a slight elastic deformation, independently of the punchings 16. This allows a connection with a good degree of impermeability.

Similarly, the distributor 20 may be inserted (in other words: fitted) in the radially inner surface 12 of the annular wall 11 with interference, i.e. with a slight elastic deformation, independently of the punchings 16.

Finally, the locking holes 24 may be in the shape of a slot longitudinally extending in the circumferential direction of the annular wall 11, so as to facilitate the alignment with the punchings 16 when no precise mutual angular positioning is required.

The manufacturing method described makes the mounting of the burner 1 faster and more cost-effective, facilitates the proper positioning of the individual components, allows a high degree of prefabrication and is particularly suitable for joining pieces of different materials and with different thicknesses.

The following description of some embodiments of the burner 1 in accordance with the invention highlights some further aspects, variants and embodiments of the manufacturing method.

FIGS. 2A to 2D show a burner 1 manufactured by means of the method in accordance with the invention, in which the first seat (radially inner surface 12) of the annular wall 11 accommodates a cylindrical or tubular distributor 20 and the second seat (radially outer surface 14) of the annular wall 11 accommodates a cylindrical or tubular diffuser 19.

FIGS. 3A to 3D show a burner 1 manufactured by means of the method in accordance with the invention, in which the first seat (radially inner surface 12) of the annular wall 11 accommodates a so-called distribution baffle 21 with a cylindrical edge which forms the locking holes 24 and with a perforated wall in the shape of a substantially plane or rounded disk, and the second seat (radially outer surface 14) of the annular wall 11 accommodates a cylindrical or tubular diffuser 19.

FIGS. 4A to 4D show a burner 1 manufactured by means of a variant of the method in accordance with the invention, in which the first seat (radially inner surface 12) of the annular wall 11 accommodates no flow element and the second seat (radially outer surface 14) of the annular wall 11 accommodates a cylindrical or tubular diffuser 19. In this embodiment, the manufacturing method is further simplified: the insertion of a flow element is not necessary, the die 30 is positioned directly inside the annular wall 11, and the projections 23 of the punchings 16 do not engage any locking hole 24.

FIGS. 5A to 5D show a burner 1 manufactured by means of a variant of the method in accordance with the invention, in which the first seat (radially inner surface 12) of the annular wall 11 accommodates a cylindrical or tubular diffuser 19, while the second seat (radially outer surface 14) of the annular wall 11 accommodates no further element of the burner.

Also in this embodiment, the manufacturing method is further simplified: the diffuser 19 is arranged with the locking holes 24 described with reference to the flow elements 20, 21, 22 and connected to the support plate 2 through the method steps described with reference to the flow elements 20, 21, 22, in particular to the distributor 20 and, precisely, instead of the flow element 20, 21, 22.

FIGS. 6A to 6D show a burner 1 manufactured by means of the method in accordance with the invention, in which the second seat (radially outer surface 14) of the annular wall 11 accommodates a cylindrical or tubular diffuser 19 and the first seat (radially inner surface 12) of the annular wall 11 accommodates a so-called anti-noise trumpet 22 having a cylindrical edge which forms the locking holes 24 and a tubular portion with at least one convergent section and axially extending in the diffuser 19.

FIGS. 7A to 7D show a burner 1 manufactured by means of the method in accordance with the invention, in which the second seat (radially outer surface 14) of the annular wall 11 accommodates a cylindrical or tubular diffuser 19, while the first seat (radially inner surface 12) of the annular wall 11 accommodates a plurality of preferably two further flow elements 20, 21, 22 overlapping each other at the annular wall 11 and both having locking holes 24 aligned with one another and both engaged by the projections 23.

In the example shown in FIGS. 7A to 7D, the first seat (radially inner surface 12) of the annular wall 11 accommodates a cylindrical or tubular distributor 20 as well as (by means of the interposition of the distributor 20) a so-called distribution baffle 21 with a cylindrical edge which forms the locking holes 24 and with a perforated wall in the shape of a substantially plane or rounded disk. Both the tubular distributor 20 and the distribution baffle 21 have locking holes 24 aligned with one another and are both engaged by the projections 23.

During the manufacturing of this embodiment, both flow elements (the tubular distributor 20 and the distribution baffle 21) are inserted overlapping in the first seat (radially inner surface 12) of the annular wall 11 and the locking holes 24 of both are aligned with one another and with the recesses 31 of the die 30, which is inserted in a more radially internal position. When making the punchings 16, the projections 23 shall have a length such as to penetrate the locking holes 24 of both flow elements 20, 21.

FIGS. 8A to 8D show a burner 1 manufactured by means of the method in accordance with the invention, in which the second seat (radially outer surface 14) of the annular wall 11 accommodates a cylindrical or tubular diffuser 19. The first seat (radially inner surface 12) of the annular wall 11 accommodates an anti-noise trumpet 22 having a cylindrical edge which forms the locking holes 24 and a tubular portion with at least one convergent section and axially extending in the diffuser 19, as well as (by means of the interposition of the anti-noise trumpet 22) a distribution baffle 21 with a cylindrical edge which forms the locking holes 24 and with a perforated wall in the shape of a substantially plane or rounded disk. Both the anti-noise trumpet 22 and the distribution baffle 21 have locking holes 24 aligned with one another and are both engaged by the projections 23.

During the manufacturing of this embodiment, both the anti-noise trumpet 22 and the distribution baffle 21 are inserted overlapping in the first seat (radially inner surface 12) of the annular wall 11 and the locking holes 24 of both are aligned with one another and with the recesses 31 of the die 30, which is inserted in a more radially internal position. When making the punchings 16, the projections 23 shall have a length such as to penetrate the locking holes 24 of both flow elements 22, 21.

FIGS. 9A to 9D show a burner 1 manufactured by means of the method in accordance with the invention, in which the first seat (radially inner surface 12) of the annular wall 11 accommodates a cylindrical or tubular distributor 20 and the second seat (radially outer surface 14) of the annular wall 11 accommodates a cylindrical or tubular diffuser 19.

Figure 9C:
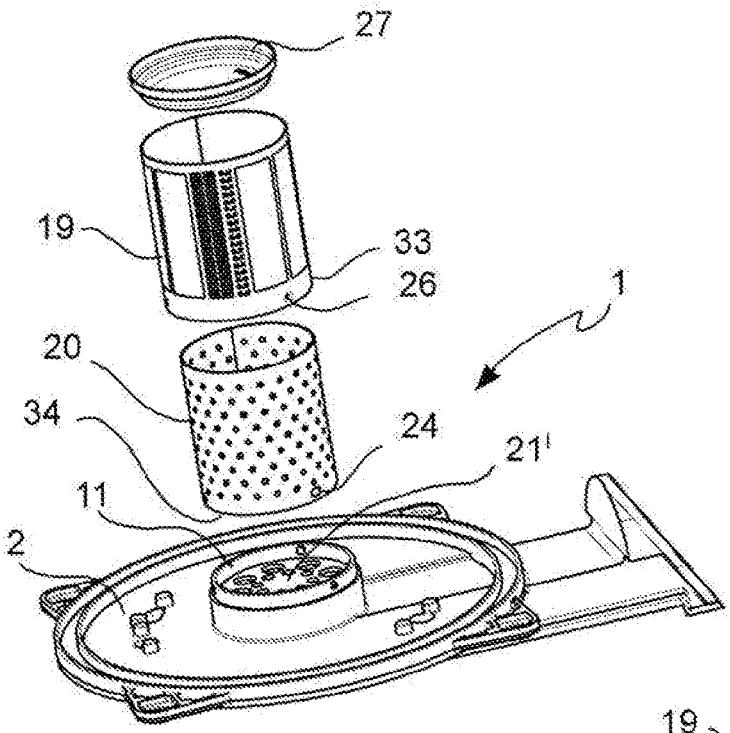
Figure 9A:
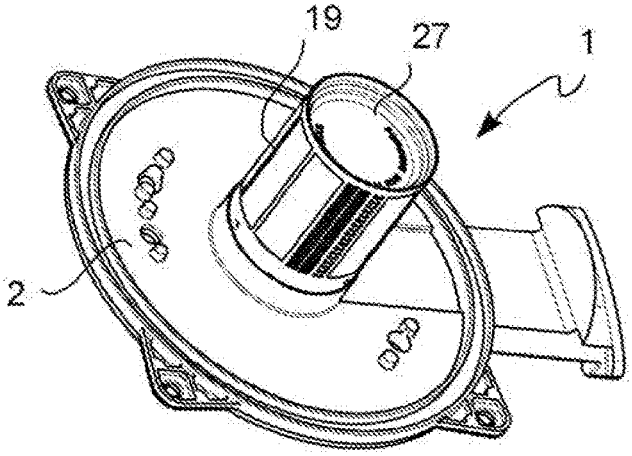
Figure 9D:
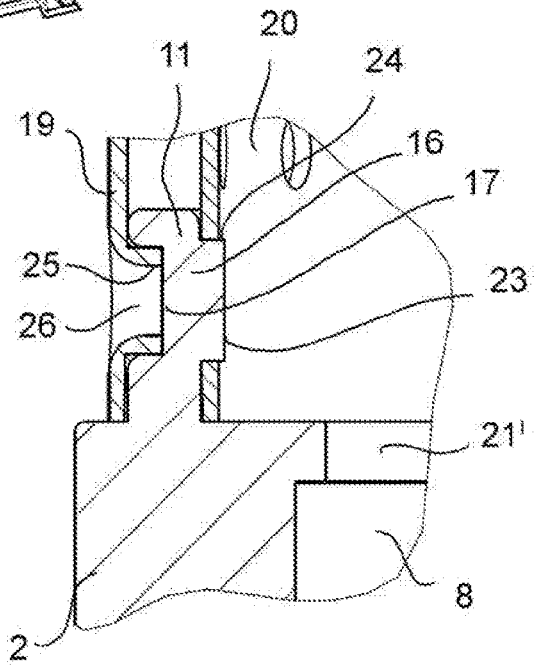
Figure 9B:
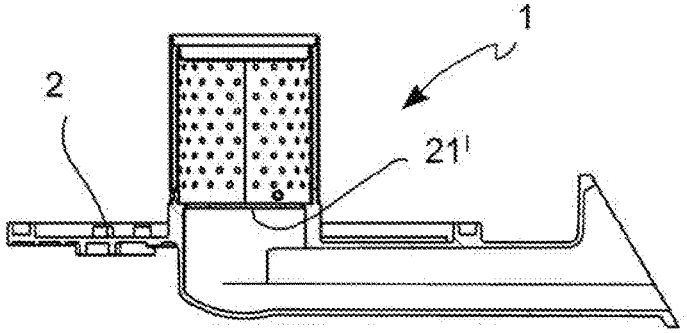
Figure 10C:
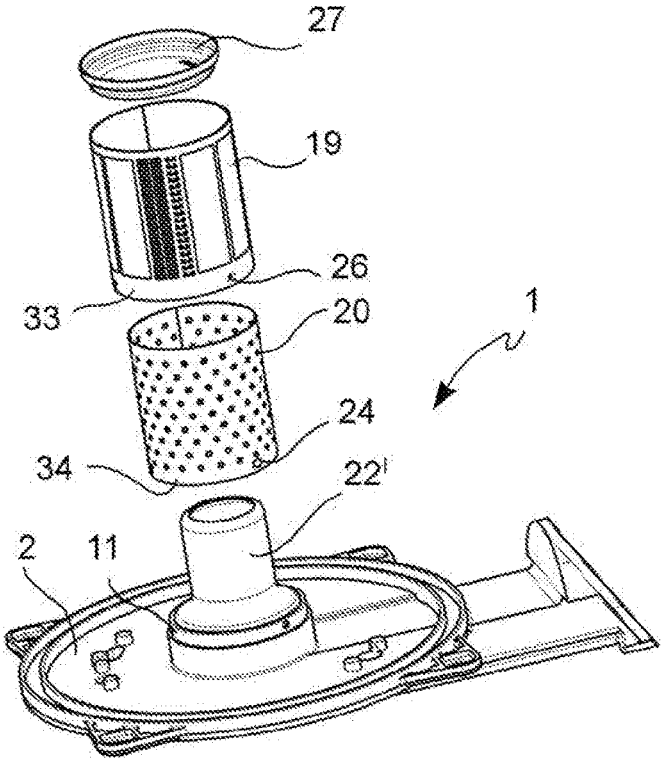
Figure 10A:
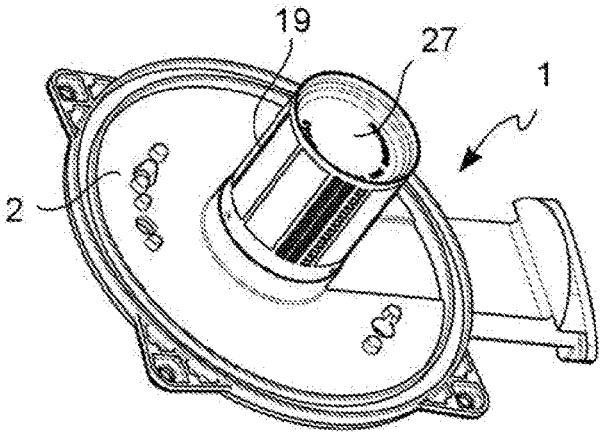
Figure 10D:
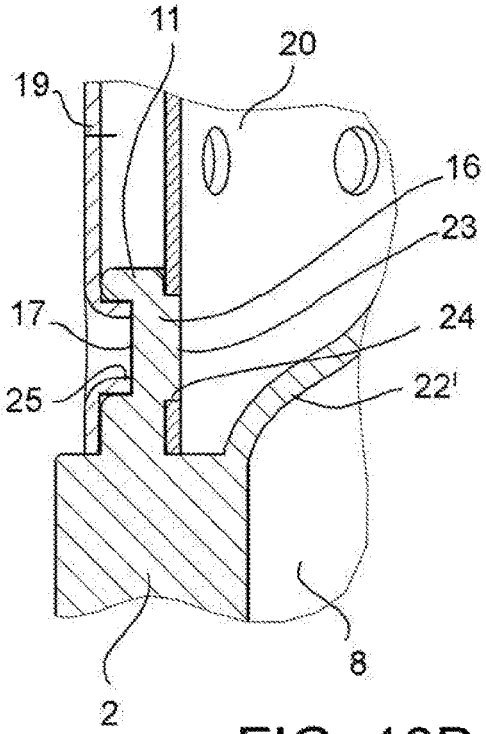
Figure 10B:
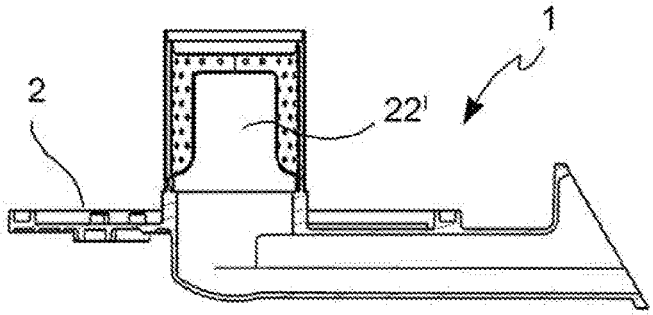
Figure 11C:
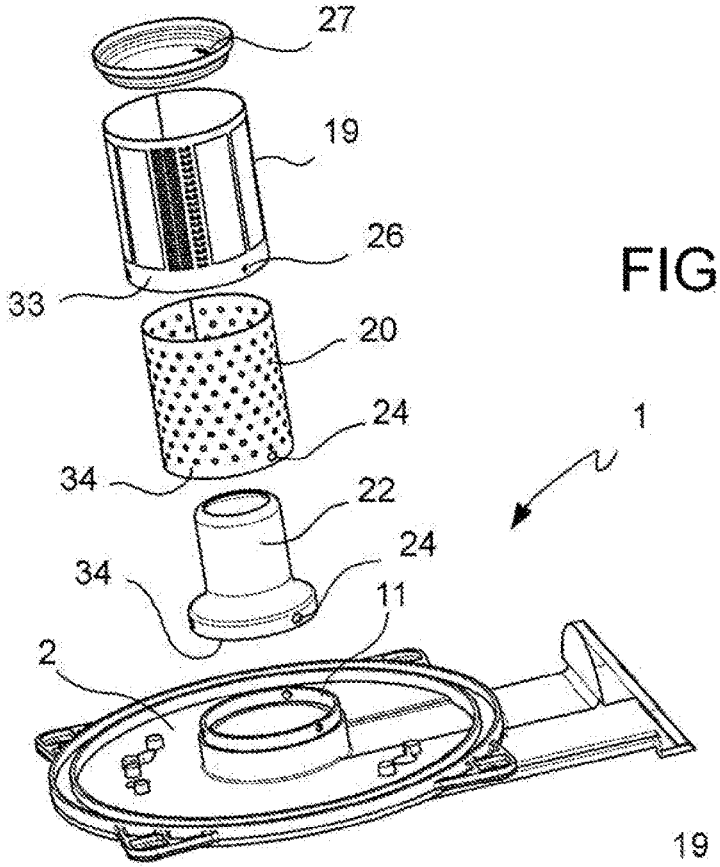
Figure 11A:
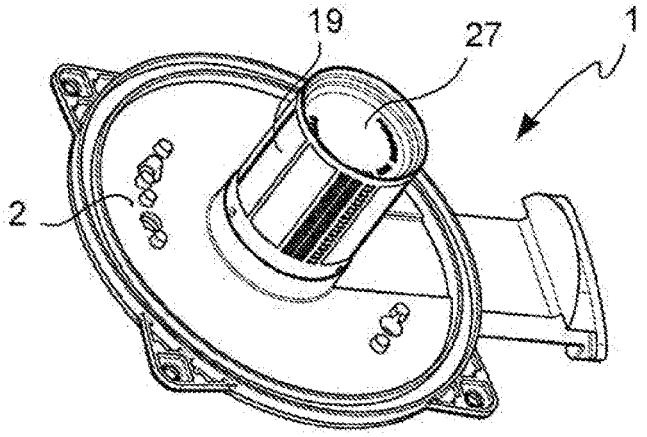
Figure 11D:
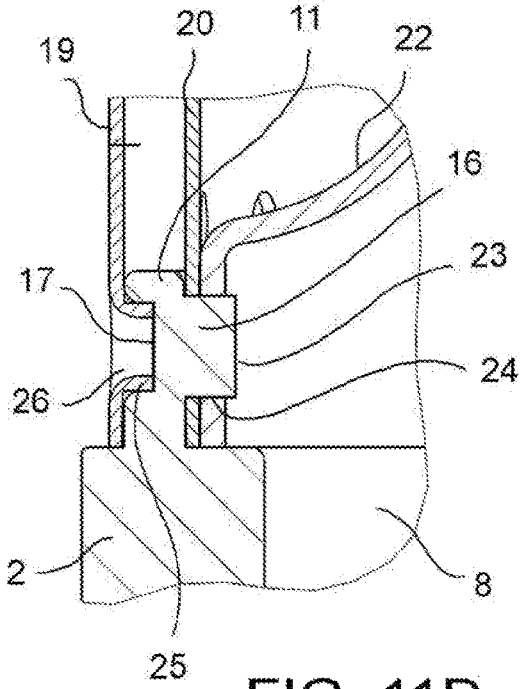
Figure 11B:
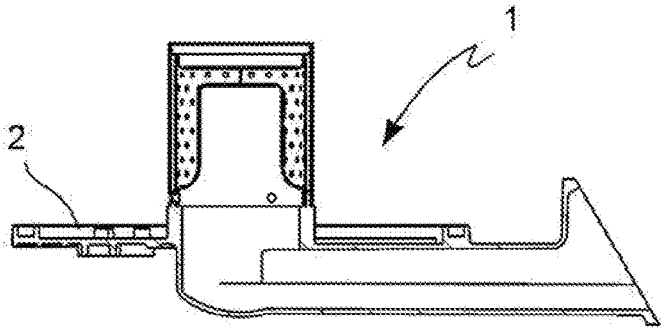

The burner 1 includes a further flow element formed directly in one piece with the support plate 2 (FIGS. 9C, 9D). In the specific case, this is a distribution baffle 21' in the shape of a perforated or multi-perforated, plane or rounded disk, and oriented on a plane substantially transverse to the longitudinal axis of the diffuser 19. The distribution baffle 21' is positioned on the side of the entrance of the mixture in the burner 1 (side of the support plate 2).

In the embodiment shown in FIGS. 10A to 10D, the further flow element directly formed in one piece with the support plate 2 is an anti-noise trumpet 22' having a tubular portion with at least one convergent section and axially extending in the diffuser 19 and, if present, in the distributor 20.

FIGS. 11A to 11D show a burner 1 manufactured by means of the method in accordance with the invention, in which the second seat (radially outer surface 14) of the annular wall 11 accommodates a cylindrical or tubular diffuser 19. The first seat (radially inner surface 12) of the annular wall 11 accommodates a cylindrical or tubular distributor 20 as well as (by means of the interposition of the distributor 20) an anti-noise trumpet 22 having a cylindrical edge which forms the locking holes 24 and a tubular portion with at least one convergent section and axially extending in the diffuser 19.

Both the tubular distributor 20 and the anti-noise trumpet 22 have locking holes 24 aligned with one another and are both engaged by the projections 23.

During the manufacturing of this embodiment, both the tubular distributor 20 and the distribution baffle 21 are inserted overlapping in the first seat (radially inner surface 12) of the annular wall 11 and the locking holes 24 of both are aligned with one another and with the recesses 31 of the die 30 (in case a die is used as an internal punching abutment). When making the punchings 16, the projections 23 shall have a length such as to penetrate the locking holes 24 of both flow elements 20, 22.

The invention claimed is:

1. Gas burner for boiler, comprising:

a diffusing wall on which the combustion takes place, a support plate for the connection of the burner to a combustion chamber, said support plate having a passage opening for the gas and a continuous or interrupted annular wall formed around the passage opening and having a radially inner surface and a radially outer surface, optionally a further flow element, wherein the diffusing wall and, optionally, the additional flow element, are connected to the support plate and in flow communication with the passage opening by mutual insertion of an annular end region thereof with the annular wall, characterized in that a plurality of punches is formed in the annular wall forming each a recess in the radially outer surface and a corresponding projection on the radially inner surface, wherein the recess is adapted to accommodate a locking protuberance of the end region of the diffusing wall and the projection is adapted to extend in a locking hole of the end region of the further flow element and/or of the diffusing wall.

2. Burner according to claim 1 wherein:

the recesses accommodate locking protuberances formed in the annular end region of the diffusing wall and the projections extend into locking holes of the further flow element, the locking protuberance is formed by an off-plane deformation of the edge of a reference hole formed in the annular end of the diffusing wall, the annular end region of the diffusing wall and/or of the further flow element is without perforation for gas passage, wherein the annular wall is made of aluminum and has a thickness greater than the thickness of the diffusing wall which is made of stainless steel, the burner comprises an upper bottom connected to an upper edge of the diffuser for closing the burner on the side opposite to the support plate.

3. Burner according to claim 2, wherein the upper bottom is connected with an upper edge of the further flow element.

4. Burner according to claim 1, wherein the further flow element includes one or more of:

a perforated distribution wall, a distribution baffle, an anti-noise trumpet, a Venturi insert.

5. Burner according to claim 2, wherein at least one of the radially inner and outer surfaces forms an insertion end step against which the flow element and/or the diffuser abut.

6. Method for manufacturing the gas burner of claim 1, comprising:

providing the diffusing wall with the annular end region having a plurality of reference holes;

providing the support plate;

providing the flow element having the annular end region with a plurality of locking holes, inserting the end region of the flow element in a female seat formed by the radially inner surface of the annular wall, punching the annular wall at positions of the locking holes to form said plurality of punches where each punching forms the recess in the radially outer surface and the corresponding projection which protrudes from the radially inner surface of the annular wall into the corresponding locking hole of the flow element, inserting the diffuser on the flow element and on a male seat formed by the radially outer surface of the annular wall and overlapping the reference holes of the diffusing wall on the recesses of the punches of the annular wall, bending, by punching, the edges of the reference hole into the recesses of the annular wall for a mutual locking thereof.

7. Method according to claim 6, comprising:

before punching the annular wall, positioning a radially expandable and retractable die inside the flow element at the annular wall and expanding the die from the inside against the flow element, wherein the die has recesses placed at the locking holes of the flow element.

8. Method according to claim 7, comprising:

during the punching of the annular wall, compressing a free end of the projection against the die so as to enlarge such a free end to hinder a radial disengagement between the projection and the locking hole.

9. Method according to claim 6, comprising:

pre-assembling the diffuser with a bottom closing the diffuser on a side opposite to the annular end region, prior to the insertion of the diffuser on the further flow element and on the annular wall.

10. Method according to claim 9, comprising:

forming the flow element and the upper bottom for a shape connection thereof, with tolerance, on the opposite side of the support plate and making said shape connection during and by means of the insertion of the diffuser—bottom assembly on the further flow element and on the annular wall.

11. Method according to claim 6, wherein, before making the punches, the further flow element is fitted with interference in the female seat of the annular wall.

12. Method according to claim 6, wherein, before bending the edges of the reference holes into the recesses of the annular wall, the diffuser is fitted with interference on the surface of the male seat of the annular wall.

13. Method according to claim 6, wherein the further flow element includes one or more of:

a perforated distribution wall,
a distribution baffle,
an anti-noise trumpet,
a Venturi insert.

* * * * *